United States Patent [19]

DuFour

[11] Patent Number: 4,655,378

[45] Date of Patent: Apr. 7, 1987

[54] DIFFERENTIAL PRESSURE BIASED SPOOL TYPE VALVE CONTROLLER FOR A PNEUMATIC DUAL DIAPHRAGM CONTROL SYSTEM

[76] Inventor: Kenneth S. DuFour, 1700 Phillips Dr., Sanford, N.C. 27330

[21] Appl. No.: 751,275

[22] Filed: Jul. 2, 1985

Related U.S. Application Data

[62] Division of Ser. No. 634,384, Jul. 25, 1984.

[51] Int. Cl.[4] ..... B65H 23/038; F16K 3/26; F16K 11/07

[52] U.S. Cl. ..... 226/23; 137/625.68; 137/625.69; 251/320; 251/325

[58] Field of Search ..... 226/22, 23, 18, 19, 226/21; 251/319, 320, 324, 325; 91/464; 137/625.68, 906, 625.25, 625.69, 877

[56] References Cited

U.S. PATENT DOCUMENTS

| | | | |
|---|---|---|---|
| 537,201 | 4/1895 | Haldeman | 251/236 X |
| 2,128,351 | 8/1938 | Cornelius | 251/237 |
| 2,908,292 | 10/1959 | Beckett et al. | 251/324 |
| 3,009,364 | 11/1961 | Beachler | 226/23 X |
| 3,043,153 | 7/1962 | Hindle et al. | 226/23 X |
| 3,071,157 | 1/1963 | Robertson et al. | 226/23 X |
| 3,160,174 | 12/1964 | Schmiel et al. | 91/464 X |
| 3,176,721 | 4/1965 | Gordon | 137/625.68 |
| 3,542,075 | 11/1970 | Kroth | 251/320 X |
| 3,563,273 | 2/1971 | Mills | 251/320 X |
| 3,566,903 | 3/1971 | Honeycutt | 91/464 X |
| 4,313,467 | 2/1982 | Lang | 251/324 X |
| 4,376,444 | 3/1983 | Michael | 251/335.2 X |

*Primary Examiner*—Harvey C. Hornsby
*Assistant Examiner*—Scott J. Haugland
*Attorney, Agent, or Firm*—Mills & Coats

[57] ABSTRACT

The invention relates to a direct acting pneumatic control system for controlling a dual diaphragm, or double acting cylinder type automatic guiding system. The control device and system is used to selectively adjust the position of one end of a guide roll relative to the opposite end, in order to adjust the position of an endless web traveling over a series of rolls.

In order to adjust and control the guide roll position, it is necessary to alternately exhaust one diaphragm, and or cylinder end, while maintaining the flow of air to the opposite diaphragm or cylinder end. This in effect shifts the end of the roll in a lateral direction, effectively steering the web in the proper direction to effect the necessary web correction.

To activate and control the valve position, the control valve is equipped with a palm which follows the web and continually monitors the web position and activates the control valve spool to modulate the "flow-exhaust" rates to bring the web to the corrected position with no over-run or "hunting" for position. The palm and rod must follow the web when the web is moving away from the palm. It is necessary to have thrust within the valve to accomplish this function. In this design this thrust is accomplished through the use of differential pressure across the spool ends with the necessary porting within the valve to accomplish the spool displacement.

14 Claims, 12 Drawing Figures

DIFFERENTIAL PRESSURE BIASED SPOOL TYPE VALVE CONTROLLER FOR A PNEUMATIC DUAL DIAPHRAGM CONTROL SYSTEM

This is a division of U.S. patent application Ser. No. 634,384, filed July 25, 1984, and entitled "SPOOL TYPE VALVE CONTROLLER FOR A PNEUMATIC DUAL DIAPHRAGM CONTROL SYSTEM."

FIELD OF INVENTION

The present invention relates to a control valve to continually monitor and control a guide roll position and to effectively cause this guide roll to be moved in the necessary direction to maintain an endless web traveling in a straight run around a series of rolls.

SUMMARY AND OBJECTS OF INVENTION

The present invention presents a spool type pneumatic controller valve which operates within a 35 to 75 psi input range and feeds this output pressure directly to a guide mechanism to accomplish necessary control and corrections. The present control valve is unique in that it is not a pilot device but handles full flow directly to diaphragms or a cylinder end without the benefit of additional linkage, mechanisms or pneumatic boosters.

The controller valve of the present invention is designed to control a guide roll very precisely and this is accomplished through the particular design of the porting within the valve. The "dead zone" or area of "no correction" at the palm's neutral position is approximately one-eighth inch. This porting design and arrangement was designed and developed to give fast and accurate response even at the low range of inlet pressure operation of 30–35 psi, and to maintain any correction to the guide roll position until an additional correction is called for as a result of a change in the position of the web or material being guided and controlled. This unique design feature of the valve controller eliminates the "hunting" characteristic usually associated with a guide valve of this type. This design feature within the controller valve is possible because of the relatively small movement of the spool within the valve body compared to web movement. The present spool design and the large ratio of palm movement to spool movement makes the valve sensitive and responsive to small changes in web position.

It is, therefore, an object of the present invention to provide a spool valve for a fluidic guiding system of the type that controls the running angle of material passing over a guide roll that overcomes many of the disadvantages and drawbacks of conventional control systems.

A further object of the present invention is to provide a control valve for a fluidic guiding system of the character referred to above which is simple in construction, includes relatively few moving parts, is reliable, and which requires little or no maintenance.

It is also an object of the present invention to provide a spool type control valve for a web guide roll guiding system that accurately and precisely responds to the movement of the web or other material passing over the guide roll.

Another object of the present invention resides in the provision of a spool type control valve for such a guiding system which includes a pivot arm directly operating the sliding spool which is responsive to lateral movement of material passing over the guide roll for actuating the spool accordingly so as to vary and control the running angle of the material passing over the same guide roll.

A further object of the present invention resides in the provision of a spool type control valve for a guiding system that is relatively inexpensive, but which is rugged in construction.

It is also an object of the present invention to provide a spool type control valve for controlling a web guiding system of the character referred to above which requires no adjustments and whose operation is not subject to temperature changes.

Still a further object of the present invention resides in the provision of a spool type control valve for a web guiding system of the character referred to above which is applicable and can be used with all web guiding applications.

A further object of the present invention resides in the provision of a spool type control valve for a web guiding system that requires no air supply treatment due to the relatively large orifices utilized.

Another object of the present invention resides in the provision of a web guiding system control valve which includes a universal mounting that enables the same to be mounted either right handed or left handed and which can be conveniently located remotely from the guiding system.

Another object of the present invention resides in the provision of a web guiding system spool type control valve that can be used on single diaphragm spring return type guiding systems by simply plugging one outlet port.

Still a further object of the present invention resides in the provision of a web guiding system control valve that includes a following arm and palm that is biased to continuously monitor the edge of the material passing over a guide roll, wherein the pressure exerted against the guide arm, in order to follow the web in a contact relationship, is of a relatively low pressure.

It is also an object of the present invention to provide a spool type control valve of the character referred to above wherein the biasing action eluded to is achieved through the accomplishment of a differential pressure across the ends of the valve's spool.

Another object of the present invention resides in the provision of a spool type control valve for a web guiding system that is completely enclosed so as to prevent contamination.

Finally it is an object of the present invention to provide a web guiding system control valve that is very compact.

Other objects and advantages of the present invention will become apparent from a study of the following description and the accompanying drawings which are merely illustrative of such invention.

DESCRIPTION OF INVENTION

Figure 1:
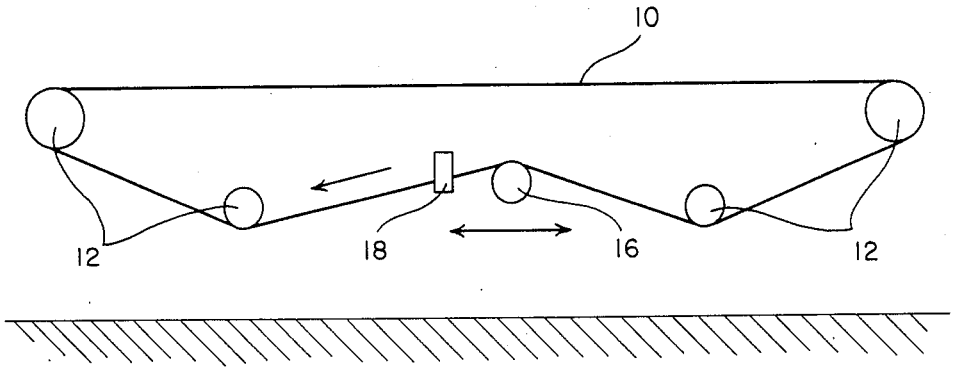
FIG. 1 is a side view illustration of an endless web passing around a series of rollers including a guide roller.

With further reference to the drawings, reference is made to FIGS. 1, 2*a*, 2*b* and 2*c* in order to illustrate the manner of maintaining proper running alignment of an endless web. In FIG. 1 an endless web 10 is shown passing around a series of carrier rolls 12. A guide roll, indicated by the numeral 16, is provided and as seen in FIG. 1 web 10 travels thereover. In addition a palm or guide arm 18 that contacts the edge of web 10 is illustrated in FIG. 1. Palm or follower 18, as will be understood from subsequent portions of this disclosure, is utilized in conjunction with a control system that is responsive to lateral or side-to-side movement of the web 10 for appropriately correcting and controlling the running alignment of the web 10.

Figures 2A, 2B, 2C:
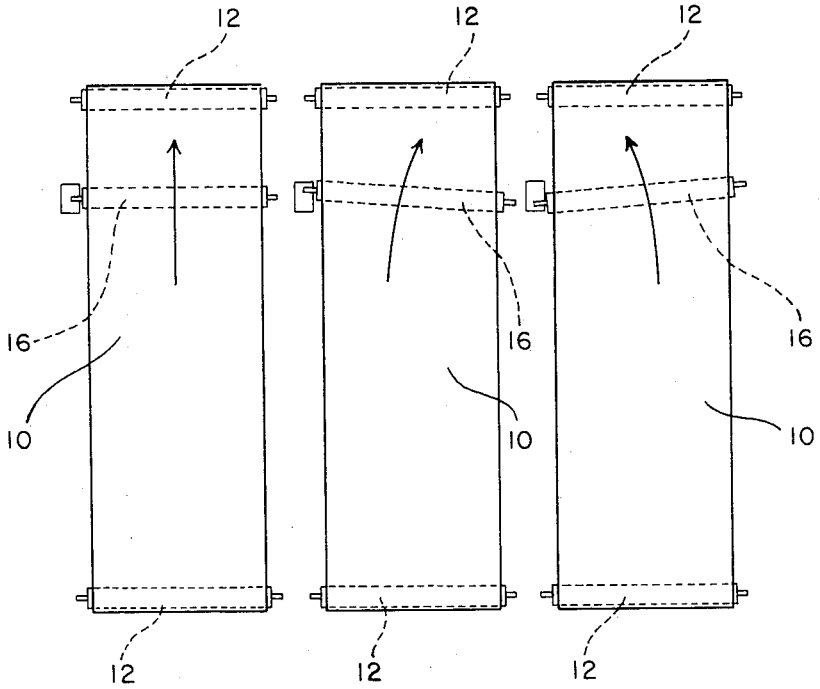
FIGS. 2*a*, 2*b* and 2*c* are top plan views, of three separate web arrangements similar to that shown in FIG. 1 wherein in each of the three cases the guide roller is shown in a particular position to illustrate the natural direction that the web tends to follow as a result of the particular positioning of one end of the guide roller.

In FIG. 2*a*, the position of guide roll 16 results in the web 10 moving in the direction of the arrow shown therein. By moving one end of guide roll 16 to the position shown in FIG. 2*b* causes web 10 to move generally in the direction of the arrow shown therein. By moving guide roll 16 to the position shown in FIG. 2*c* results in the web 10 moving in the direction of the arrow as shown therein.

Therefore, in the case of an endless web 10, it is desirable to continuously sense the position of the edge of the web 10 with a palm or follower 18 (as illustrated in FIG. 1) and in response to that position to adjust the end of guide roll 16 so as to appropriately control and correct the alignment of the web 10.

Figure 3:
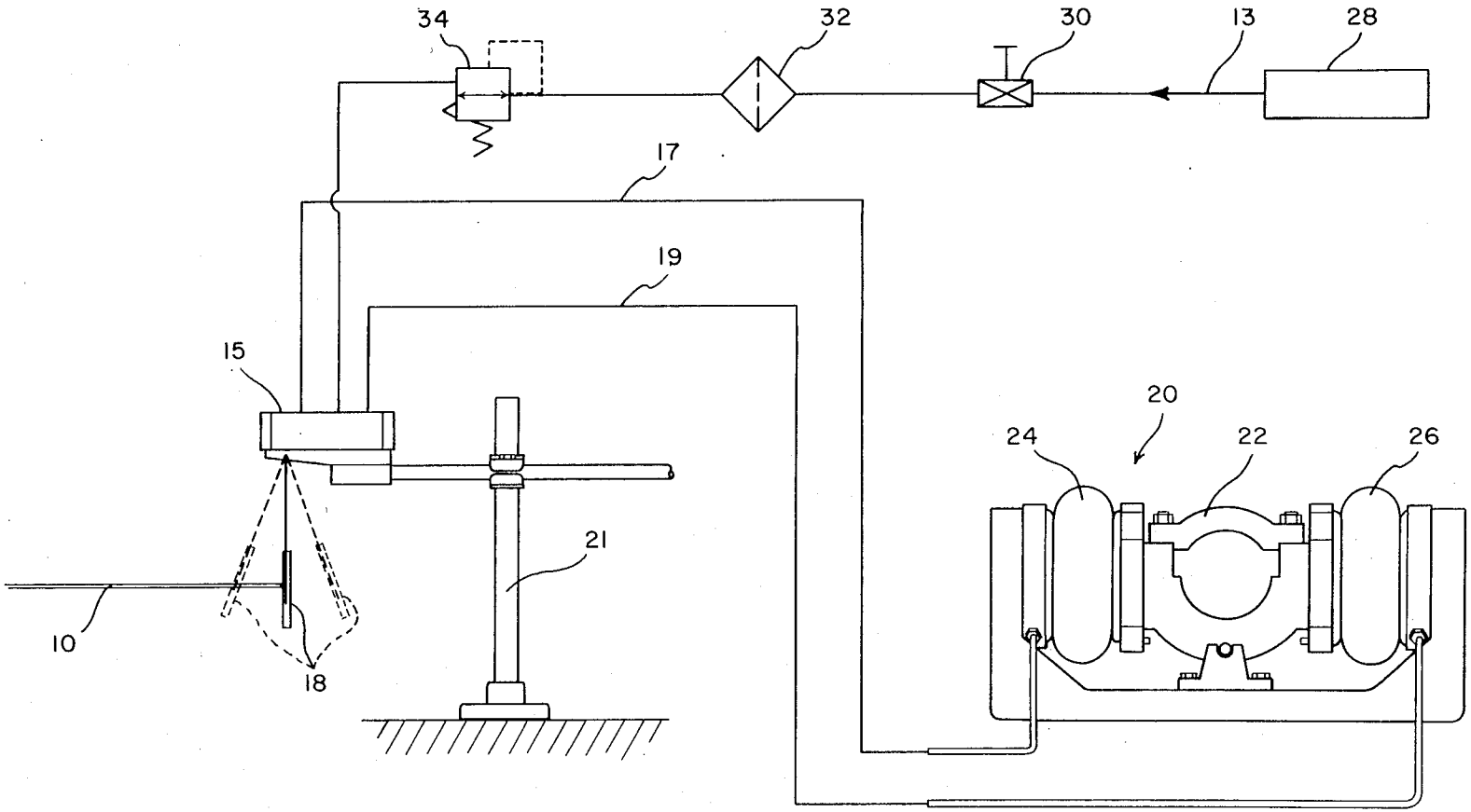
FIG. 3 is a schematic illustration of the guide roll, control valve, and associated plumbing for directing air to and through the control valve and into the guide roll control system.

Now turning to FIG. 3, an actuator or guide system for moving guide roll 16 back and forth is shown therein and indicated generally by the numeral 20. Actuator 20 is of a conventional design and includes a saddle bearing holder 22 that is designed to receive an end bearing assembly of guide roll 16. Disposed on each side of saddle bearing holder 22 is a pair of diaphragms 24 and 26. It is appreciated that by inflating and deflating the respective diaphragms 24 and 26, that saddle bearing holder 22 and accordingly guide roll 16, can be moved back and forth. It is this back-and-forth control movement that results in the continuous control of the alignment of web 10.

The present invention particularly relates to a control valve, indicated generally by the numeral 15, for controlling actuator 20 and the respective diaphragms 24 and 26 thereof. Details of the control valve will be specifically dealt with subsequently herein. Prior to viewing details of controller valve 15, a general discussion of the air flow to the control valve and on to the actuator 20 will be dealt with.

In this regard, reference is made to FIG. 3. Therein an air supply indicated by the numeral 28 is provided. Air from air supply 28 is directed through an inlet line 13 to a particular inlet port of the control valve 15. Air passing through line 13 will pass through an on-off valve 30, filter 32 and a pressure regulator 34.

Control valve 15 is mounted adjacent the traveling web 10 by a support structure 21. As will be discussed in more detail subsequently herein, control valve 15 includes a palm or follower 18 that continuously monitors the edge of web 10 and responds to the lateral movement thereof so as to continuously vary the output flow from control valve 15. Note in FIG. 3 that control valve 15 further includes two additional ports, that again will be discussed in more detail subsequently herein. These two ports are operatively connected to diaphragms 24 and 26 via lines 17 and 19.

Figures 4, 5:
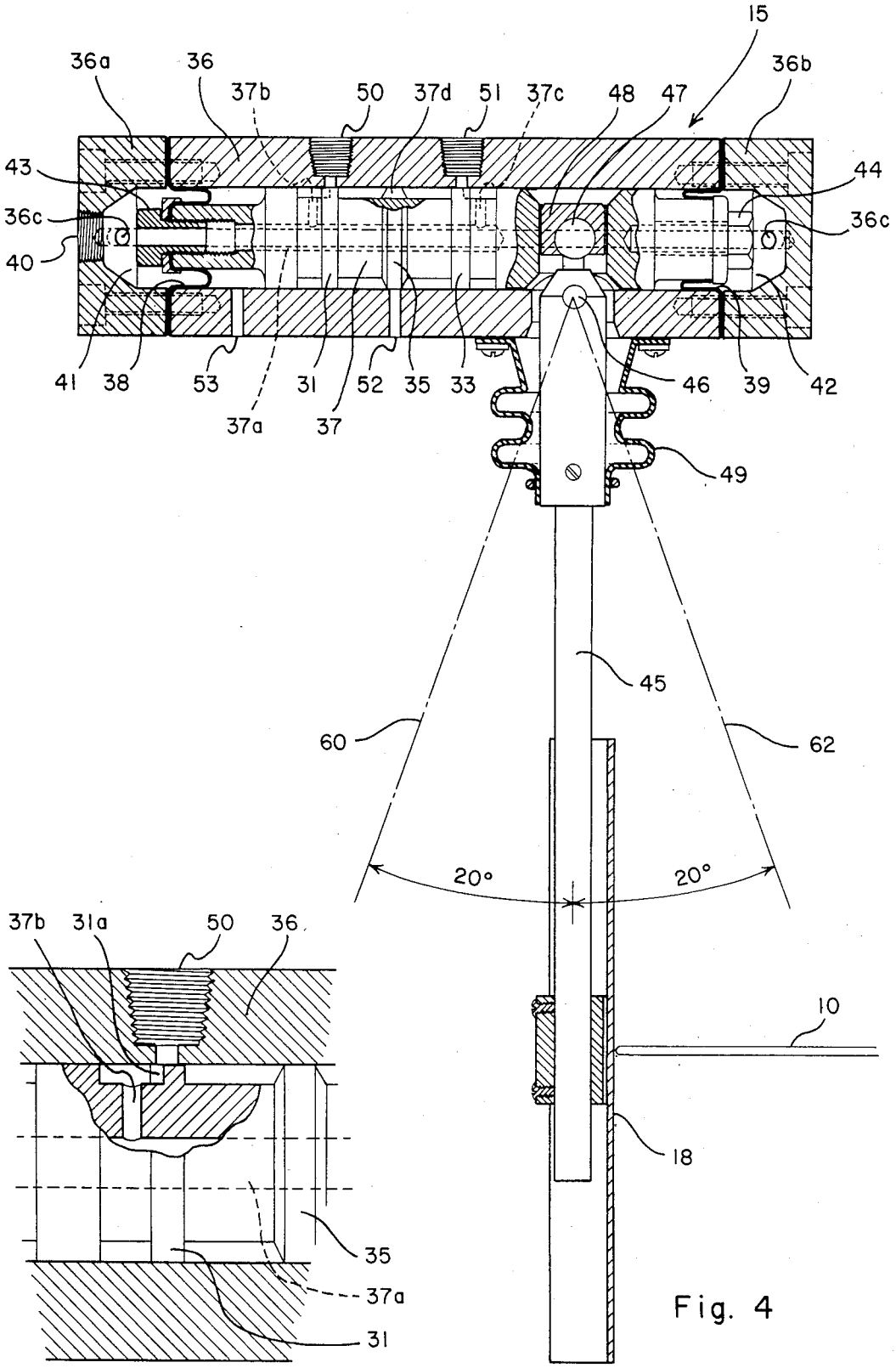
FIG. 4 is a sectional view illustrating the spool type controller of the present invention with the spool being shown in a neutral position.
FIG. 5 is a fragmentary enlarged sectional view showing a selected portion of the valve and its spool with the spool being in the neutral position.

Turning to FIG. 4, there is shown therein a spool type valve controller, indicated generally by the numeral 15. Control valve 15 comprises a housing structure 36 which includes a sliding spool 37. Secured to each end of the spool by hardware 43 and 44 are rolling diaphragms 38 and 39. These diaphragms are also secured between housing 36 and respective end covers 36*a* and 36*b* thereby forming separate chambers 41 and 42 at each end of spool 37.

Figure 5A:
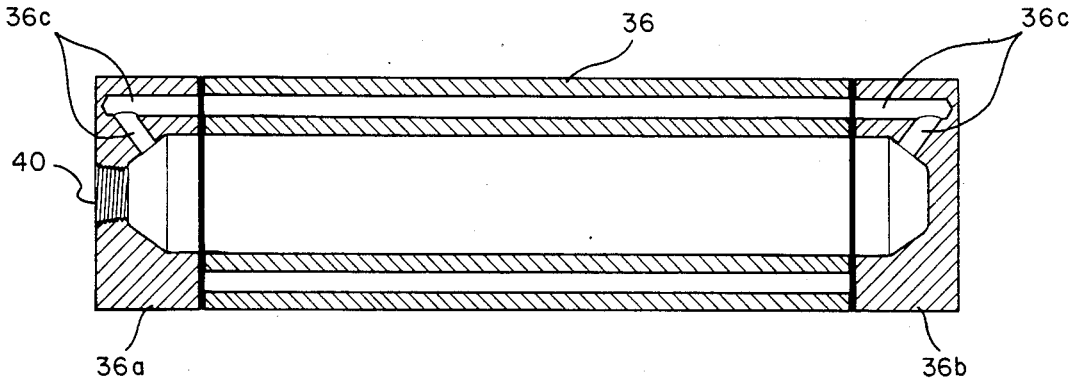
FIG. 5A is a sectional view of the valve shown in FIG. 4 particularly illustrating the side by-pass air channel formed in the body of the valve that enables air to be channeled to both sides of the spool.

Valve 15 includes an inlet port 40 formed in end cover 36*a* that directs inlet pressure to both chambers 41 and 42 through a by-pass port 36*c* formed in housing 36 and end caps 36*a* and 36*b*. This by-pass port 36*c* is shown particularly in FIG. 5A.

By specifically designing a suitable difference in an effective area between diaphragms 38 and 39, the spool is biased to assure that palm 18 and connecting rod 45 will follow the web 10 being guided.

Pressure supply to the valve proper is accomplished through a port 37*a* formed through the center of spool 37. Flow gains entrance to port 37*a* through an opening located in retaining screw 43. Port 37*a* terminates short of the palm actuating mechanism area but extends sufficiently to feed pressure ports 37*b* and 37*c*.

Continuing to refer to FIG. 4, a rod 45 extends from pivot arm 47 which is pivotably mounted to valve body 36 through a pivot pin 46. This imparts thrust to spool 37 in either a left or right direction, the particular direction being determined by the movement of palm 18. A ball cap 48 is designed to receive pivot arm 47. Ball cap 48 includes a circular section and is fitted in a mating circular bore in spool 37. This allows the rotary motion of pivot arm 47 to convert to sliding motion between ball cap 48 and spool 37. Expressed in another way, as rod 45 is swung back and forth, pivot arm 47 can rotate or oscillate in ball cap 48 and ball cap 48 can move transversely or back and forth within the spool 37 and within the confines of the valve housing 36. This design essentially permits the rod 45 and extending palm 54 to effectively move spool 37 back and forth.

A bellows 49 is provided to protect the interior of the valve from exterior contaminants and as shown in FIG. 4 extends from the valve body 36 to cover the pivot arm 47 extending from the valve.

Provided in valve housing 36 are two outlet ports 50 and 51. In addition there is an exhaust port 52. A vent 53 is provided to prevent the build up of back pressure against diaphragm 38 by any pressure leakage past spool 37.

Formed on spool 37 is a raised annular exhaust control shoulder 35 that is flanked on each side by raised annular control collars 31 and 33. Exhaust shoulder 35 includes a transverse channel or cross over 37*d* which allows air entering the valve through either ports 50 or 51 to cross over and be exhausted through exhaust port 52. It is appreciated that the shifting of spool 37 in either direction will allow exhaust port 52 to be opened to one of the ports 50 or 51.

As seen in FIGS. 4 and 5, in a neutral position, outlet ports 50 and 51 are aligned with respective raised annular collars 31 and 33 so that the ports 50 and 51 assume a generally closed position. However, the annular collars 31 and 33 are each slightly notched so as to continuously supply a pressure to each of the diaphragms 24 and 26 of the actuator or guiding system 20. This compensates for any pressure loss due to "blow by" when the valve is in a neutral position. Note in FIG. 5 that the notched area of annular collar 31 is specifically shown and referred to by 31*a*.

In FIG. 4 valve 15 is shown in the neutral position. In the neutral position, inlet air enters port 40 and spool ports 37*a*, 37*b* and 37*c*. This maintains inlet air pressure on outlet ports 50 and 51. Exhaust port 52 is closed.

In FIG. 4 construction line 60 represents palm position No. 2 which moves a maximum of twenty degrees from the neutral position. In this position port 50 is fully open to inlet pressure via ports 37*a* and 37*b*. Port 51 is opened to exhaust port 52 via cross over 37*d*.

Also in FIG. 4, construction line 62 represents a third palm position. In this third position, the palm 54 moves a maximum of twenty degrees to the right of the neutral position, as shown in FIG. 4. In this third palm position, port 51 is fully open to inlet pressure via ports 37*a* and 37*c*. Port 50 is opened to exhaust port 52 via cross over 37*d*.

Palm position No. 2 and palm position No. 3 occur at the full extremes of the palm's movement. When palm 54 moves slightly toward construction line 60, outlet port 50 becomes increasingly exposed to inlet pressure and outlet port 51 becomes increasingly exposed to exhaust port 52. For minor corrections to the web 10 position, the flow rates are low and the corresponding speed of correction is slow. This design eliminates overreaction and consequent "hunting" of the guide. Essentially the flow to the respective diaphragms 24 and 26 (or to a cylinder end) is proportional to the displacement of palm 18 relative to the neutral position.

The opposite conditions prevail when palm 18 moves slightly towards the No. 3 position (construction line 62). That is, outlet port 51 becomes increasingly exposed to inlet pressure while outlet port 50 becomes increasingly exposed to exhaust port 52. Again the flows are proportional to spool displacement.

Figure 6:
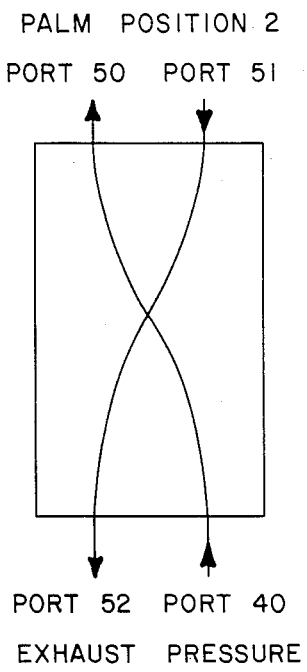
FIG. 6 is a schematic illustration of the control valve of the present invention illustrating the flow of air therethrough when the palm of the control valve as shown in FIG. 4 assumes the leftmost extreme position (position No. 2).
Figure 7:
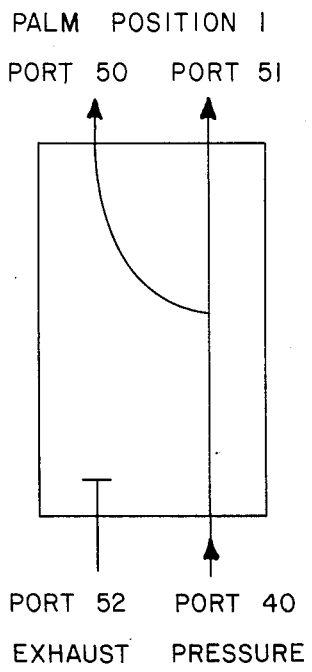
FIG. 7 is a schematic illustration of the control valve of the present invention illustrating the flow of air therethrough when the palm of the control valve as shown in FIG. 4 assumes the neutral position (position No. 1).
Figure 8:
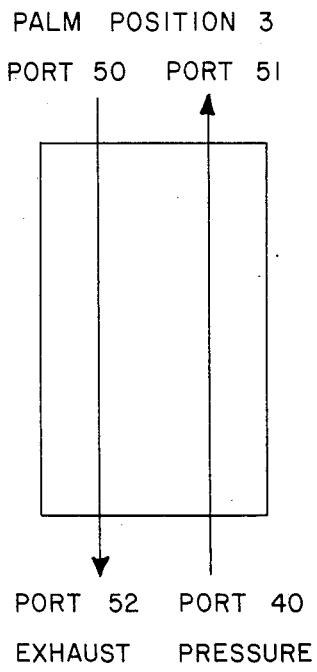
FIG. 8 is a schematic illustration of the control valve of the present invention illustrating the flow of air therethrough when the palm of the control valve as shown in FIG. 4 assumes the rightmost extreme position (position No. 3).

In FIGS. 6, 7 and 8, the flow of fluid or air through valve 15 is illustrated in each of the three positions just described. In FIG. 6, palm position No. 2 (construction line 60) is illustrated. In FIG. 7, the neutral position is illustrated. FIG. 8 illustrates the third position or the position occupied by the palm when the same assumes that position represented by construction line 62 in FIG. 4.

It should be reiterated that valve 15 and spool 37 are particularly designed such that the effective areas on the opposite side of the spool are not equal. Because of this there exists a differential pressure across the ends of the spool 37 and in the present case, this results in the spool tending to be displaced toward the left (see FIG. 4). Therefore, it is appreciated that palm 18 follows the edge of the web or material 10 passing over guide roll 16. As the palm 18 follows the edge of web 10, the rod or swing arm 45 is operative to control actuator or guiding system 20. As the palm 18 oscillates between the two extreme positions indicated in FIG. 4, it is appreciated that the respective diaphragms 24 and 26 are alternately inflated and exhausted and this results in the end of guide roll 16 being moved laterally back and forth so as to adjust the running angle of the material or web 10 passing over the various carrier rolls 12.

Figure 9:
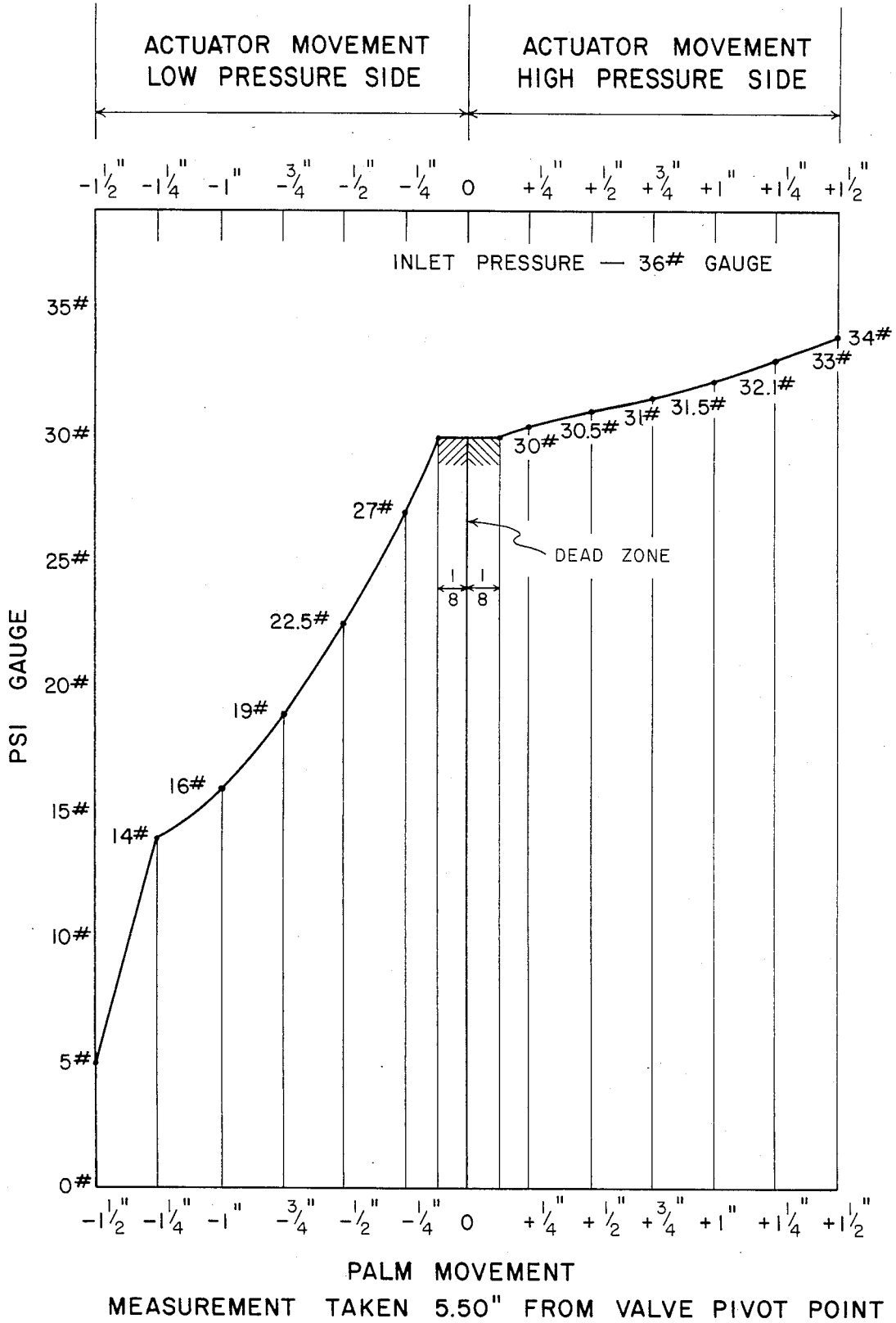
FIG. 9 is a graph illustration showing pressure measurements for various palm movements of the control valve of the present invention.

FIG. 9 displays a graph of actual diaphragm pressures plotted from the zero or neutral position of the actuator or guide roll carrier. These pressures are given for each 0.25" of palm movement, and illustrate the gradual and relatively straight line increase in pressure on the high pressure side and the corresponding decrease in pressure on the exhaust or low pressure side.

The gradual increase in force on the high pressure side results in a very uniform speed of movement, and provides precise control of the guide roll through the entire range of movement.

Reversal of high pressure and low pressure sides would result in a mirror image of the graph.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A spool type controller assembly for controlling and directing air from an air source to either side of a dual diaphragm pneumatic guiding system that is operatively connected to a guide roll for moving and adjusting the guide roll so as to appropriately guide materials such as wire or felt web over the guide roll, said type controller valve comprising:

A. a valve having a body, a spool having opposite ends movably mounted therein, an air inlet port, a pair of outlet ports, an exhaust port means formed therein with each outlet port being adapted to be communicatively connected to a respective diaphragm of said pneumatic guiding system;

B. a pair of rolling diaphragms secured across opposite ends of said spool so as to form opposed chambers adjacent each end of said spool and to generally seal the formed opposed chambers from the adjacent areas surrounding said spool;

C. biasing means operatively associated with said spool for biasing the same towards a selected position within said valve, said biasing means including means for generating a pneumatic differential pressure between the opposed chambers and across said opposite ends of said spool such that because of the presence of the differential pneumatic pressure said spool is biased towards a selected position;

D. spool actuating means for engaging an edge of said material passing over said guide roll and moving said spool back and forth within said valve in response to the lateral shifting of said material as the same passes over said guide roll wherein the movement of said spool, as a result of the lateral movement of said material, results in the guiding system adjusting the position of said guide roll so as to adjust the running angle of the material passing over said guide roll;

E. wherein said spool actuating means includes a pivot arm means directly coupled to said spool for moving said spool back and forth within said valve as said pivot arm means is moved back and forth, said pivot arm means including an inner end movably mounted to said spool and extending therefrom and further including a remote end having a follower secured thereto for engaging the edge of said material passing over said guide roll, such that said pivot arm means actuates and moves said spool back and forth within said valve in response to the lateral shifting of the material passing over said guide roll;

F. said spool and pivot arm adapted to assume a first neutral position and wherein from said neutral position said pivot arm may pivot to second and third extreme positions on each side of said neutral position; and G. wherein said valve and spool include means for opening said outlet ports and exposing the same to air pressure while closing said exhaust port means in response to said spool and pivot arm assuming said neutral position, thereby preventing the valve from performing unnecessary corrections.

2. The spool type controller of claim 1 wherein said inlet port is connected to a source of compressed air and wherein said means for generating said differential pressure includes the pair of chambers disposed adjacent opposite ends of said spool and communicatively connecting said inlet port to the opposed chambers for receiving and holding compressed air therein and wherein said compressed air within said chambers acts against adjacent ends of said spool, and wherein one end of said spool includes a greater effective surface area exposed to the compressed air of the adjacent chamber than the other end of said spool thereby giving rise to said differential pressure across the opposite ends of said spool and wherein said spool is biased by said differential pressure toward the end of the spool opposite the end having the greater surface area exposed to the adjacent chamber.

3. The spool type controller of claim 1 including a joint assembly operatively interconnected between said spool and said pivot arm means.

4. The spool type controller of claim 3 wherein said joint assembly includes a cavity actually formed in said spool and an opening providing access thereto, and a movable member contained within said cavity and operatively connected to said pivot arm means such that as said pivot arm is moved back and forth said spool is likewise moved via said joint assembly.

5. The spool type controller of claim 4 further including a pivot pin connecting said pivot arm means with said valve adjacent said joint assembly converting rotary to sliding motion.

6. The spool type controller of claim 5 including a pivot arm opening formed in said valve through which said pivot arm means projects, and wherein there is provided a flexible boot secured to said valve adjacent said pivot arm opening and which encompasses a portion of said pivot arm extending from said valve.

7. The spool type controller of claim 3 including means for moving said joint assembly back and forth within said valve in a direction transverse to the longitudinal axis of said spool as said pivot arm is swung back and forth.

8. The spool type controller of claim 1 wherein there is provided securing means for securing each rolling diaphragm directly to the end of said spool such that said diaphragm rolls back and forth with said spool as the same is actuated; and wherein there is further provided means for securing said diaphragm to said valve body such that the respective diaphragms can roll back and forth with said spool.

9. A method of controlling a dual diaphragm fluid type control system that in turn controls the running angle of materials such as a web passing over a guide roll of the control system, said method comprising:

A. providing a valve with a spool having a follower operatively connected thereto for engaging and following the material passing over the guide roll, two outlet ports and an exhaust port and operatively interconnecting the valve between said dual diaphragm fluid type control system and a source of fluid pressure;

B. securing a pair of rolling diaphragms across opposite ends of said spool so as to form opposed chambers adjacent each end of said spool and to generally seal the formed opposed chambers from the area surrounding said spool;

C. biasing the spool to a first position by generating a pneumatic differential pressure across opposed chambers and the ends of said spool;

D. moving said spool back and forth within said valve to alternately direct fluid to each of the dual diaphragms of said fluid type control system for moving said guide roll back and forth and accordingly varying the running angle of material passing over said guide roll;

E. communicatively connecting said outlet ports with the dual diaphragms of the fluid control system;

F. moving said spool back and forth through a neutral position within said valve to alternately direct fluid to each of the dual diaphragms of said fluid type control system for moving said guide roll back and forth and accordingly varying the running angle of material passing over said guide roll;

G. opening said two outlet ports and exposing the same to pressurized air and closing said exhaust port in response to said spool assuming said neutral position, thereby maintaining the corrected position of the guide roll until such time as a new corrected position is called for by additional movement of the material and a corresponding movement of the follower and spool;

H. said steps of moving said spool back and forth within said valve including engaging the edge of the material passing over said guide roll with a follower;

I. moving a pivot arm back and forth in accordance with the movement of said follower; and J. connecting said pivot arm with said spool and moving said spool back and forth in response to said pivot arm being moved back and forth so as to control the flow of said fluid from said valve to said respective diaphragms of said dual diaphragm control system for moving and adjusting the position of the guide roll and varying the running angle of material passing over said guide roll.

10. The method of claim 9 including the step of directing fluid into an inlet within said valve and into opposed chambers disposed on opposite ends of said spool, and providing a greater spool exposed surface area to the adjacent chamber about one end of said spool than the other so as to generate a differential pressure across the spool ends so as to naturally bias the spool toward the spool end opposite the end with the greater surface area exposed to the adjacent chamber.

11. A spool type control valve that utilizes a differential pressure across the spool to bias the spool comprising: a valve body; a spool having opposed ends movably mounted within said valve body and movable therein between first and second extreme positions; a fluid inlet port formed in said valve body and adapted to be connected to a fluid source; outlet port means formed in said valve body; exhaust port means formed in said valve body; a pair of rolling diaphragms secured across opposite ends of said spool so as to form opposed chambers adjacent each end of said spool and to generally seal the formed opposed chambers from areas surrounding said spool; and means for forming a differential pressure across the opposite ends of said spool and for biasing said spool towards one of said extreme positions due to the differential pressure existing across the opposite ends of the spool, said means for generating said differential pressure including means for communicatively connecting said inlet port with said opposed chambers such that an activating fluid may be directed into said chambers and wherein the fluid pressure within the chambers acts against adjacent ends of said spool, and wherein one end of said spool includes a greater effective surface area exposed to the fluid pressure of the adjacent chamber than the other end of said spool thereby giving rise to said differential pressure across the opposite ends of said spool and wherein said spool is biased by said differential pressure toward the end of the spool opposite the end having the greater surface area exposed to the adjacent chamber.

12. The spool type control valve of claim 11 wherein there is provided securing means for securing each rolling diaphragm directly to the respective end of said rolling spool such that said diaphragm moves back and forth with said spool as the same is moved and actuated; and wherein there is further provided means for securing said rolling diaphragms to said valve body such that the respective diaphragms can move back and forth with said spool.

13. The spool type control valve of claim 11 wherein said spool is movable back and forth past a neutral position and wherein said valve includes means for opening said outlet port means and closing said exhaust port means in response to said spool assuming said neutral position.

14. The spool type control valve of claim 11 wherein said means for communicatively connecting said inlet port with said opposed chambers includes a by-pass port formed in said valve body with said by-pass port extending through said valve body and around said spool for channeling air to opposite sides of said spool.

* * * * *